US007305729B2

(12) United States Patent
Dehner

(10) Patent No.: US 7,305,729 B2
(45) Date of Patent: Dec. 11, 2007

(54) COMBINATION TOOL FOR CUTTING AND ROLLING

(76) Inventor: Howard Dehner, 56 Craycroft Ave., Debary, FL (US) 32713

( * ) Notice: Subject to any disclaimer, the term of this patent is extended or adjusted under 35 U.S.C. 154(b) by 0 days.

(21) Appl. No.: 11/343,113

(22) Filed: Jan. 30, 2006

(65) Prior Publication Data

US 2007/0033740 A1 Feb. 15, 2007

Related U.S. Application Data

(60) Provisional application No. 60/706,833, filed on Aug. 9, 2005.

(51) Int. Cl.
*B26B 11/00* (2006.01)
*B26B 1/08* (2006.01)

(52) U.S. Cl. ..... 7/158; 30/162

(58) Field of Classification Search ..... 7/158, 7/167; 30/162, 164, 320, 335, 339, 293, 30/125

See application file for complete search history.

(56) References Cited

U.S. PATENT DOCUMENTS 4,068,375 A * 1/1978 Rathbun et al. ..... 30/125
4,761,882 A * 8/1988 Silverstein ..... 30/162
4,884,342 A 12/1989 McNamara et al.
4,910,821 A 3/1990 Kieferle
4,974,320 A 12/1990 Pelletier
5,014,429 A 5/1991 McNamara
5,072,471 A 12/1991 Isler
5,561,906 A * 10/1996 Desmarais ..... 30/339
6,161,290 A * 12/2000 Takamasa ..... 30/162
D441,631 S 5/2001 Carroll
6,226,824 B1 5/2001 Hopson et al.
2004/0216309 A1 11/2004 Mueller
2004/0250425 A1 12/2004 Arent et al.
2005/0034309 A1 2/2005 Arent et al.

FOREIGN PATENT DOCUMENTS

GB 2098120 A * 11/1982

* cited by examiner

*Primary Examiner*—Hadi Shakeri
(74) *Attorney, Agent, or Firm*—Gene Scott; Patent Law & Venture Group

(57) ABSTRACT

A dual use hand tool apparatus has a handle portion of a length fully extensive over a palmer portion of a hand firmly gripping the handle portion. The apparatus also has a barrel portion that is integral and contiguous with the handle portion. The handle and barrel portions are mutually positioned to form an obtuse angle of from about 125 and 145 degrees. A cutting blade is at least partially enclosed within the barrel portion and a compression wheel is longitudinally extensive from the handle portion. Pressure applied to the compression wheel causes the cutting blade to retract into the barrel portion.

10 Claims, 3 Drawing Sheets

COMBINATION TOOL FOR CUTTING AND ROLLING

CROSS-REFERENCE TO RELATED APPLICATIONS

This application claims priority of a prior filed Provisional Patent Application with Ser. No. 60/706,833 and filing date of Aug. 9, 2005, which is incorporated herein by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to hand held cutting tools and more specifically to combination tools incorporating cutting and rolling features.

2. Description of Related Art Including Information Disclosed Under 37 CFR 1.97 and 1.98

Hopson et al., U.S. Pat. No. 6,226,824, discloses a knife with multiple roller wheels comprising an elongate hollow housing adapted to be held and operated by one hand. The housing has a first end with a slot and an opposite second end. A knife blade is provided. A structure is for retractably extending the knife blade from the slot in the first end of the housing to trim a window screen. Two roller wheels are also provided. A facility is for rotatably supporting in spaced apart relationships the two roller wheels. An assembly pivotally connects the supporting facility to one side of the housing adjacent to the second end. A stop member supports the supporting facility in a stationary position, so that one of the roller wheels will extend beyond the second end of the housing to install the window screen in a window screen frame. Carroll, U.S. Pat. No. 441,631, discloses an ornamental design for a rug cutter, as shown. Isler, U.S. Pat. No. 5,072,471, discloses a tool especially designed for a workman in a particular industry that has an elongate handle with a retractable sliding knife blade at a first end. At a second end a pair of rotatable wheels are mounted. When constructed for screen installation, one of the wheels has a convex edge for forming the screen in the groove of the screen frame and the other wheel has a concave edge for firmly holding a locking spline and forcing it into the groove to lock the screen in place. Where constructed for the paperboard box fabricator, one of the wheels has piercing points for laying out a pattern (a pounce wheel) and the other wheel has a convex edge for pressing a folding groove into the paperboard. The tool makes it possible for the worker to perform three different tasks normally performed in sequence with a single, hand-held tool to speed up his work, the knife being for trimming off screen or paperboard as required. McNamara, U.S. Pat. No. 5,014,429, discloses a utility knife that includes a mechanism for detaching the individual blade segments along segmentation lines from a segmented knife blade. The detachment mechanism includes a plunger located at the forward end of the utility knife. An adjustment mechanism advances the knife blade for alignment between the plunger and a retention chamber. Actuation of the plunger exerts a transverse force on the blade segment, detaching same from the remainder of the blade. The retention chamber prevents the detached blade segment from flying from the utility knife where it could cause injury or damage. Optionally, the utility knife may include a spare blade storage compartment and/or a guidance mechanism to facilitate the cutting of straight or curved lines in particular situations. Pelletier, U.S. Pat. No. 4,974,320, discloses an improved utility knife that includes a handle with a razor cutting blade end and a toothed cutting wheel end. An alternate embodiment includes a necked handle with a toothed cutting wheel affixed to a retractable arm which thereby allows the toothed cutting wheel to be retracted within the handle. A measuring device retention means is located near the toothed cutting wheel such that drywall can be measured and scored at the same time. Kieferle, U.S. Pat. No. 4,910,821, discloses a screen installer's tool for use when installing screening material in a frame. The tool is designed to be held in the hand with a knife blade at one end and a rotatable screen forming wheel at the other end. The body of the tool is made in two parts joined together by screws with an internal compartment which houses a supply of knife blades and also a slidable knife blade carrier. The carrier includes a finger-operable detent and pawl for permitting slidable movement of the carrier and knife blade in and out of the internal compartment so that when not in use the knife blade is locked in place within the tool body. McNamara et al., U.S. Pat. No. 4,884,342, discloses a cutting device that includes a handle and blade. The blade being detachably connectable to the handle, and the handle including a guidance mechanism. This guidance mechanism has a convex peripheral edge and is rotatively connected to the handle. The cutting device also includes an engagement and disengagement mechanism for operatively interrelating the blade with the guidance mechanism. Arent et al., US 2005/0034309, discloses a tool for cutting compressible material, such as fiberglass insulation, comprised of a handle, a pivotable blade carrier housing, a blade carrier, with or without a razor blade slidable within the blade carrier and a compression wheel means. A slidable locking mechanism slidably coupling the razor blade within the blade carrier allows the razor blade to be retracted into the tool. Pulling the tool along the surface of insulation material while applying downward pressure to the handle and hence compression wheel allows the rotating wheel to compresses the compressible material allowing a razor blade to make a straight cut through the entire thickness of the compressible material. Arent et al., US 2004/0250425, discloses a tool for cutting insulation that is comprised of two elongated mating handles connected at a central point. A blade/blade carrier and compression wheel with gear like teeth is supported between the handle halves. An optional releasable locking mechanism in the handle allows the blade to be retracted into the tool. Pulling the tool along the surface of insulation material while applying downward pressure to the compression wheel and blade allows the rotating wheel to grip and compresses the material allowing the blade to make a straight cut without tearing. Mueller, US 2004/0216309, discloses a heavy-duty utility knife with ergonomic finger and thumb positions in relation to an internal stabilizer pivot structure that includes a wheel for safer, stronger, smoother for more efficient cutting. The said invention also provides the user with an easy access, blade change and storage feature. This feature allows for proficiency of task, as well as, creating a safe knife with skid plate to prevent injury.

The related art described above discloses various hand tools using a combination of cutting and material rolling capabilities. However, the prior art fails to disclose such hand tools allowing for improved gripping, fast changeover from cutting to rolling, and an automatically retracting the blade by simply initiating roller action. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A dual use hand tool apparatus has a handle portion of a length fully extensive over a palmer portion of a hand firmly gripping the handle portion. The apparatus also has a barrel portion that is integral and contiguous with the handle portion. The handle and barrel portions are mutually positioned to form an obtuse angle of from about 125 and 145 degrees. A cutting blade is at least partially enclosed within the barrel portion and a compression wheel is longitudinally extensive from the handle portion. Pressure applied to the compression wheel causes the cutting blade to retract into the barrel portion.

A primary objective inherent in the above described apparatus and method of use is to provide advantages not taught by the prior art.

Another objective is to provide a duel hand tool incorporating a cutter and a roller.

A further objective is to provide such a tool in a superior ergonomic shape with improved grasping and placement of the downward force directly over the axle of the roller wheel.

A still further objective is to provide such a tool that has automatic blade retraction to prevent cutting oneself or others when using the rolling feature.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

FIGS. 3-5 are vertical sectional views of the apparatus with:

Figure 3:
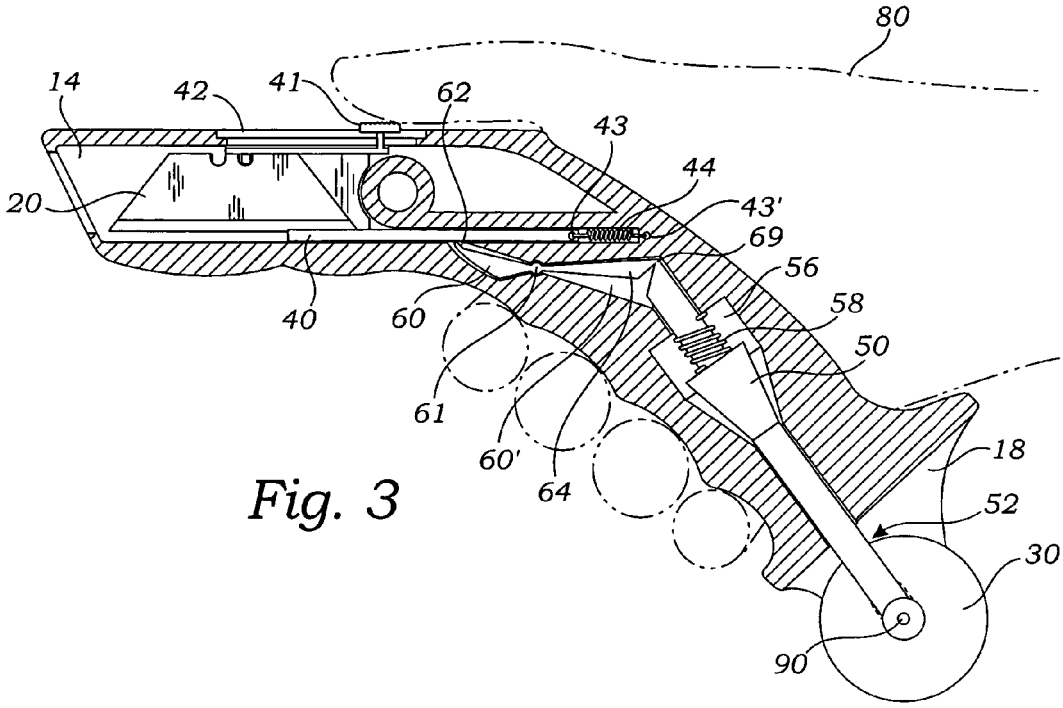
Figure 4:
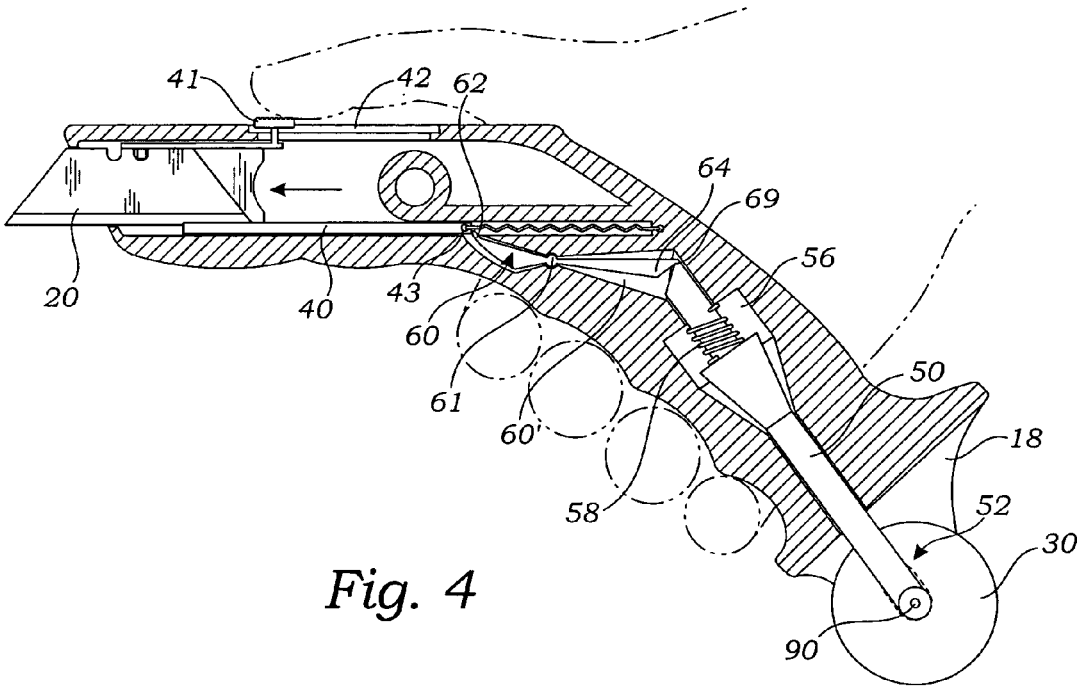

FIG. 3 showing a first embodiment with a user's hand placed ready for pushing the blade into an extended position;

FIG. 4 showing the cutting blade manually extended; and

Figure 5:
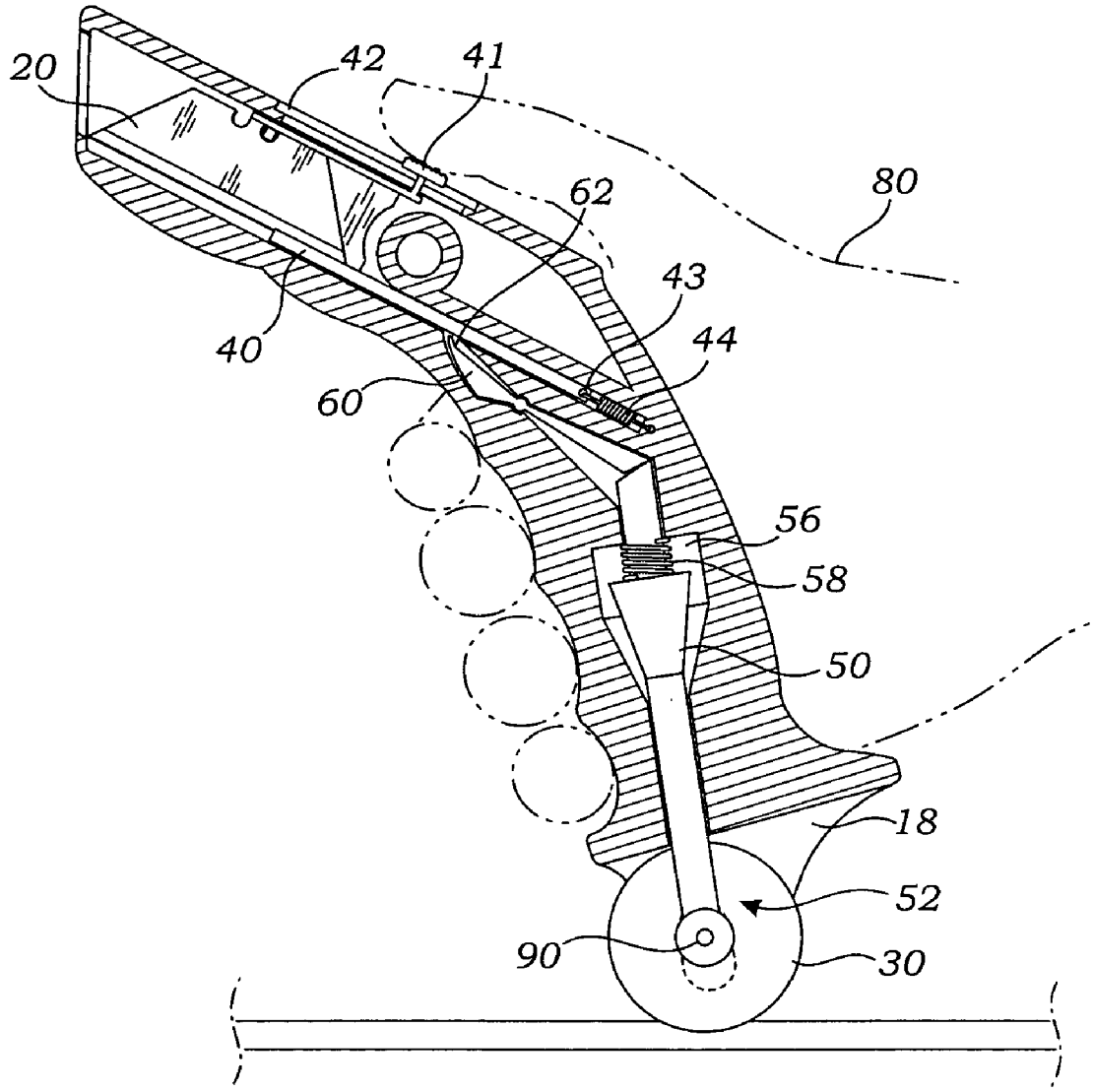

FIG. 5 showing use of the compression wheel.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
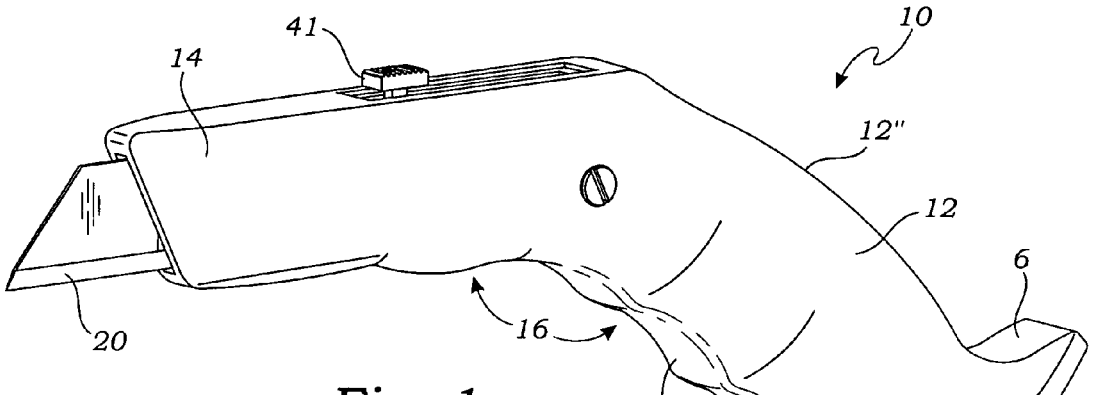
FIG. 1 is a perspective view of the presently described apparatus with a cutting blade extended in readiness for cutting operation.
Figure 2:
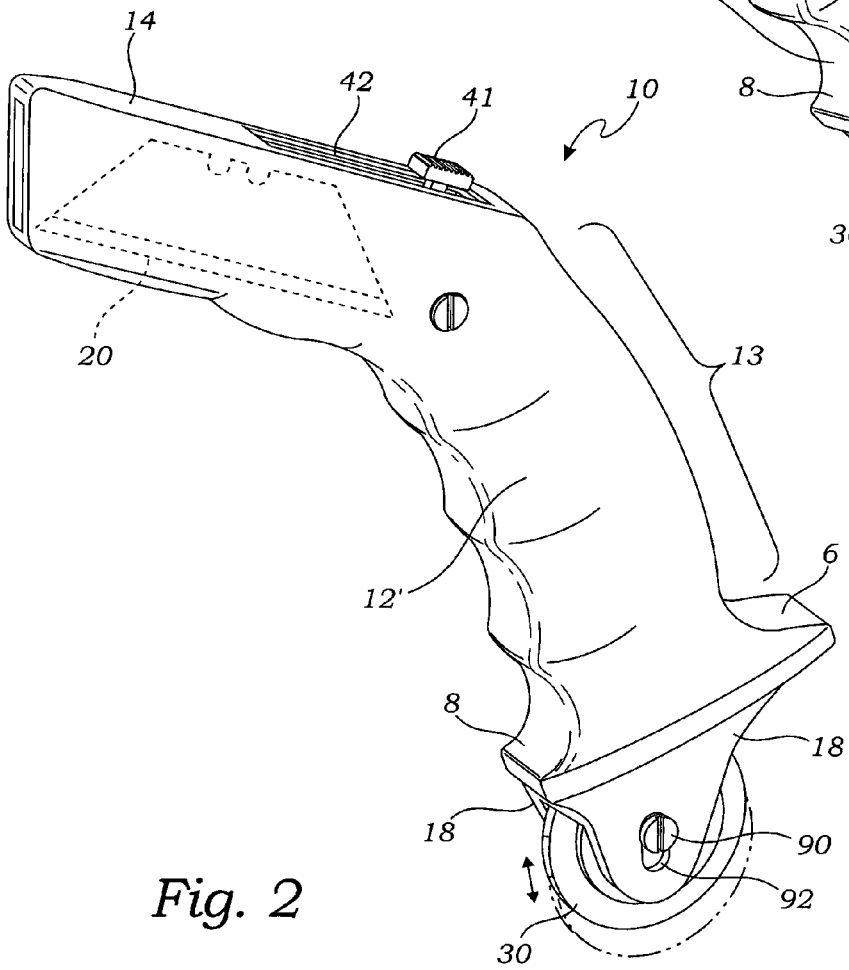
FIG. 2 is a perspective view thereof with the compression wheel depressed and the cutting blade retracted in readiness for rolling operation.

Described now in detail is a dual use hand tool apparatus. A rigid metallic or plastic housing 10 consists of a handle portion 12 integral with a barrel portion 14 as shown in FIGS. 1 and 2. The handle portion 12 is of an ergonomic shape preferably having finger wells 12' and in opposition, an arcuate surface 12" so that it may be gripped firmly, securely and comfortably. The handle portion 12 is of a length 13 extending fully over the palmer portion of a user's hand 80 as is shown in FIGS. 3-5. The barrel portion 14 is of a length sufficient for receiving a cutting blade 20 when it is fully retracted within the barrel portion 14. The handle 12 and barrel 14 portions are each essentially linear in form and are integrally joined at an obtuse angle 16 which is critical in dimension. The size of the obtuse angle 16 is between 125° and 145° as best seen in FIGS. 1 and 2 and this angle 16 is of critical consequence to the comfort, physiological safety and efficient operation of the tool. As shown in the figures, the handle portion 12 has a flared-out portions 6 and 8 for resting the hand and fingers on when gripping the handle portion 12. These portions 6, 8 enable the tool to be better balanced, allow the hand grip to be less than extremely tight and controls the downward force of the hand through an axle of its wheel 30 when the tool is in use for rolling operations.

It should be realized that this tool is typically used continuously for 8 to 10 hours per day by craftsmen cutting and rolling screening materials within window and door frames. Therefore, it is critical to have both cutting and rolling features within the same tool in order to save the time necessary to stop work, put down one tool, and pick up another tool. The further benefit of having both tools in one hand-gripping package is the ability to roll-cut-roll-cut-roll-cut, etc. It is estimated that about 30 to 40 percent of work time may be shaved from a typical work cycle using the present tool as opposed to two separate tools. Furthermore, the exact angular range between the two portions as specified above lends this tool uniquely to accomplishing the cutting and rolling operations in a highly efficient, improved manner. In all the prior art (described above) tools, one must reverse the tool to change between cutting and rolling operations, while in the present tool, because of the angular arrangement, the tool is used with a single pistol type grip and both cutting and rolling operations are accomplished without changing grip position. Greater angles (>145) have been found to require an uncomfortable overextension at the wrist causing fatigue during work, or requiring an uncomfortable hunched over position of the body. Lesser angles (<125) has been found to bring the tip of the blade 20 into contact with the screening fabric at too high an angle thereby causing premature dulling of the blade.

The cutting blade 20 is preferably of the type common to box cutters and is enclosable within the barrel portion 14 of the tool, as is shown in FIGS. 3-5. A screening material compression wheel 30 of metal or hard plastic construction, is mounted on, and extends longitudinally from, the handle portion 12 and is rotatable in a manner consistent with standard rolling tools as shown in FIG. 2. As shown in FIGS. 3-5, a rigid blade holder 40 is slidingly mounted within the barrel portion 14 so that it is able to move between the position shown in FIG. 3 and the position shown in FIG. 4. The prior art described above clearly teaches the use of moving blade holders in manual tools and the manner in which such blade holders secure a blade and in which they may be manually extended, locked in the extended position, retracted and locked in the retracted position. Blade 20 is mounted in blade holder 40 so that it is able to be extended and retracted as shown. Extension may be accomplished by quickly jerking the apparatus so that the blade 20 is moved to the extended position against a retraction spring 44 as shown in FIG. 4 by centripetal force, or it may be manually extended using a push lever 41 as is indicated in FIGS. 3 and 4.

As shown in FIGS. 2 and 3, the push lever 41 extends from the barrel portion 14 upwardly through a slot 42 in barrel portion 14 and is movable by a thumb of hand 80 while gripping the handle portion 12. Blade 20 is engaged with holder 40 for movement of the blade 20 within barrel portion 14. A retraction spring 44 (an expansion type spring) engages the holder 40 at a holder terminal end 43 and is anchored to the interior of housing 10 at its other end 43', and acts to bias the holder 40, blade 20 and lever 42 toward the retracted position shown in FIG. 3.

In an alternate and improved embodiment of the above apparatus, a push rod 50, of rigid plastic or metallic construction, is mounted in a longitudinal recess 56 in the handle portion 12 and is axially movable therewithin. The compression wheel 30 engages a distal end 52 of the push rod 50 rotationally at axle 90 so that wheel 30 is able to freely rotate. The axle 90 rides in slots 92 within spaced apart extensions 18 fixed to handle portion 12.

A lock lever 60 is located within a lock lever recess 60' in housing 10 and is pivotable about a pivot axle 61. As shown in FIGS. 3-5, a lever terminal end 62 is positioned against holder 40 while its other end 64 is positioned against push rod 50 and indeed is hingably joined with it, for instance, by a flexible thin web 69. In operation, when blade 20 is in its recessed position, as shown in FIG. 3, a push rod spring 58 (a compression spring) is under slight compression so that it tends to push push rod 50 downward, thereby driving lock lever 60 against holder 40 as lock lever 60 pivots about pivot axle 61. When blade 20 is extended, as shown in FIG. 4, the holder terminal end 43 moves to the left of the lever terminal end 62 allowing the lever terminal end 62 to catch the holder terminal end 43 as shown in FIG. 4 thus locking the holder 40 and blade 20 in the extended position. When the wheel 30 is pressed down onto a surface, as shown in FIG. 5, push rod 50 is driven upward within handle 12 and this rotates lock lever 60 counterclockwise in FIG. 5, so that lever terminal end 62 is drawn away from holder terminal end 43 releasing the holder 20 and allowing retraction spring 44 to withdraw holder 40 into the barrel 14. At this point retraction spring 44 is relaxed. When wheel 30 is lifted from the surface, push rod spring 58 drives push rod 50 and wheel 30 downward, but has no effect upon the blade holder 40 as shown in FIG. 3.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A dual use hand tool apparatus comprising: a housing having a handle portion of a length fully extensive over a palmer portion of a hand when the hand firmly grips the handle portion; and integral and contiguous with the handle portion, a barrel portion; a cutting blade mounted in a blade holder, the blade holder movable so as to position the cutting blade between a retracted position within the barrel portion, and a position extending from the barrel portion; a compression wheel extending from the handle portion; a push rod movable within a longitudinal recess in the handle portion, the compression wheel engaging a distal end of the push rod and longitudinally movable therewith; and a lock lever pivotally rotational within a lock lever recess in the housing, a terminal end of the lock lever positionable against the blade holder such that with the blade holder in the extended position, the terminal end of the lock lever engages a terminal end of the blade holder thereby locking the blade holder in the extended position, an other end of the lock lever engaged with the push rod, such that movement of the push rod toward the blade holder disengages the lock lever from the blade holder thereby enabling the blade holder to withdraw into the barrel portion.

2. The apparatus of claim 1 further comprising a lever extensive from the barrel portion and engaged with the blade holder, the lever positioned so as to be moved by a thumb of the hand while gripping the handle portion.

3. The apparatus of claim 2 further comprising a retraction spring engaged with the blade holder so as to bias and draw the blade holder, blade and extension lever into the retracted position.

4. The apparatus of claim 1 further comprising a push rod spring engaged with and biasing the push rod away from the blade holder thereby rotating the terminal end of the lock lever into contact with the blade holder.

5. The apparatus of claim 1 further comprising opposing flared-out portions of the handle portion, the flared-out portions of such size and conformation as to enable resting the hand thereon when gripping the handle portion.

6. A dual use hand tool apparatus comprising: a housing having a handle portion and a barrel portion; a blade holder movable between a retracted and extended positions within the barrel portion; a compression wheel mounted on the handle portion and engaged with a push rod movable within the handle portion; a lock lever pivotal within the housing between a position locking the blade holder in the extended position, and a position for releasing the blade holder when the push rod moves toward the blade holder thereby enabling the blade holder to withdraw into the barrel portion.

7. The apparatus of claim 6 further comprising a lever extensive from the barrel portion and engaged with the blade holder, the lever positioned so as to be moved by a thumb of the hand while gripping the handle portion.

8. The apparatus of claim 7 further comprising a retraction spring engaged with the blade holder so as to bias and draw the blade holder, blade and extension lever into the retracted position.

9. The apparatus of claim 6 further comprising a push rod spring engaged with and biasing the push rod away from the blade holder thereby rotating the terminal end of the lock lever into contact with the blade holder.

10. The apparatus of claim 6 further comprising opposing flared-out portions of the handle portion, the flared-out portions of such size and conformation as to enable resting the hand thereon when gripping the handle portion.

* * * * *